United States Patent [19]

Frost et al.

[11] 4,333,518

[45] Jun. 8, 1982

[54] METHOD FOR IMPROVING THERMAL SHOCK RESISTANCE OF HONEYCOMBED STRUCTURES FORMED FROM JOINED CELLULAR SEGMENTS

[75] Inventors: Rodney I. Frost, Corning; Robert D. McBrayer, Painted Post; Vimal K. Pujari, Corning, all of N.Y.

[73] Assignee: Corning Glass Works, Corning, N.Y.

[21] Appl. No.: 205,776

[22] Filed: Nov. 10, 1980

[51] Int. Cl.[3] ..... B32B 3/12; B32B 1/08

[52] U.S. Cl. ..... 165/8; 156/290; 156/304.1; 156/308.4; 428/65; 428/116; 428/194

[58] Field of Search ..... 428/65, 73, 116, 194, 428/118, 195, 44; 156/197, 290, 291, 304.1, 308.4; 165/8, 10

[56] References Cited

U.S. PATENT DOCUMENTS 3,160,131 12/1964 George et al. ..... 428/118

3,918,517 11/1975 Silverstone et al. ..... 165/10

FOREIGN PATENT DOCUMENTS 2022071 12/1979 United Kingdom .

*Primary Examiner*—Paul J. Thibodeau

*Attorney, Agent, or Firm*—Richard N. Wardell

[57] ABSTRACT

The thermal shock resistance of a honeycombed structure or a structure having a honeycombed surface formed by bonding together a plurality of cellular segments each having a honeycombed face forming a portion of the structure or surface of the structure, respectively, is improved by recessing the bond joints between the joined cellular segments from the surface. The thermal shock resistance of a heat recovery wheel operated in a counterflow heat exchanger system and formed from joined cellular segments is improved by recessing the bond joints joining the cellular segments, preferably approximately one-half inch (12.7 mm), from the face of the wheel exposed to the gases at their highest temperatures.

18 Claims, 5 Drawing Figures

METHOD FOR IMPROVING THERMAL SHOCK RESISTANCE OF HONEYCOMBED STRUCTURES FORMED FROM JOINED CELLULAR SEGMENTS

BACKGROUND OF THE INVENTION

This invention relates to a method of forming honeycomb structures from joined cellular segments so as to improve the structure's thermal shock resistance, and in particular to a method of constructing a heat recovery wheel having improved thermal shock resistance and the wheel produced thereby.

Honeycomb structures are used in a variety of applications, such as catalytic reactors and heat recovery wheels for conditioning flowing fluids, primarily gases. Such structures consist primarily or entirely of a matrix having a plurality of apertures or hollow, open-ended cells which permit the passage of fluids through the structure. Because these structures are subjected to relatively severe thermal shock conditions during operation, they are commonly fabricated from ceramic or glass-ceramic materials having very low coefficients of thermal expansion. Other materials (e.g., glass, sintered metal, cermet or other ceramic base materials) could be employed as desired if they were suitable (e.g. sufficient strength, chemical resistance, refractoriness, thermal shock resistance, etc.) with the service conditions encountered.

Honeycombed structures are generally formed monolithically by the processes of extrusion of "wrapping" (the building up of corrugated layers). If sufficiently large, however, the structures must be built from joined cellular segments, themselves formed by either process. For example, for some time the Corning Glass Works has fabricated large heat recovery wheels (up to 70 inches (178 cm) in diameter) by joining cellular segments formed by the wrap process from material having very low coefficients of thermal expansion ($10\times10^{-7}$/°C. or less over the range of 0° to 1000° Centigrade). The wheels were formed having cement bond joints extending continuously across the open annular faces of the resulting wheel. In attempting to construct industrial sized heat recovery wheels (approximately 28 inches (71 cm) or greater in diameter) from materials having greater coefficients of thermal expansion (approximately $18\times10^{-7}$/°C. or more over the range 0° to 1000° Centigrade), it has been learned that this prior method of joining the cellular segments to one another is a significant cause of thermally induced stresses in the joint areas of the wheel during operation. Some thermal stress reduction in these areas can be achieved by creating discontinuities through the joints in the direction extending in the direction of the fluid flow through the honeycombed structure and is the subject of a co-pending application Ser. No. 205,775 filed Nov. 10, 1980 and assigned to the assignee of this application.

Heat recovery wheels are typically operated in counterflow heat exchanger systems. The wheels are rotated through opposing flows of relatively hot and cold gases, the hot gas heating the matrix material when passing through it and the cold gas absorbing the heat held by the matrix material while passing through the wheel during the second half of its rotation. By passing the gases in opposite directions through the wheel, one annular face of the wheel can be maintained at a higher average temperature than the other, increasing the thermal efficiency of a given wheel and reducing the thermal shock to which each face is subject. Applicants have determined that the previously employed method of bonding cellular segments together by using continuous joints which extend up to and across the open annular faces of the wheel was a significant cause of spalling and fracture of the matrix, especially on the face of the wheel exposed to the highest temperatures, due to nonlinear temperature differences which develop in the axial direction in the matrix and the tendency of the bonding material to transmit stresses between the cellular segments. Applicants believe that these relationships were not heretofore perceived.

SUMMARY OF THE INVENTION

It is an object of this invention to provide a method of forming a honeycomb surface, such as is found on a heat recovery wheel, from joined, cellular segments having improved thermal shock resistance and the improved surface produced thereby.

It is a further object to provide an improved heat recovery wheel formed from joined cellular segments.

It is a further object to accomplish such improvements by reducing the transmission of stresses between adjoining cellular segments in a composite structure, such as a heat recovery wheel, through the bond joints joining the segments to one another.

Applicants accomplish the aforesaid objects and others in forming a honeycombed structure or structure with honeycombed surface from a plurality of monolithic segments, each segment having a honeycomb surface formed from a plurality of cells or apertures and bonded to one another through one or more bond joints between their side walls, by relieving the bond joints from the resulting honeycombed surface. Applicant's have found that a nonlinear temperature difference arises along the length of cells forming a honeycombed structure, such as a heat recovery wheel, from the passage of a fluid having a different temperature therethrough, the temperature change in the cells being greater where the fluid first enters. Since the magnitude of thermally induced stresses in such a structure are proportional to, among other factors, temperature differences, the maximum thermal stresses are also found, at least initially, near the surface of the structure where the fluid first enters. If the structure is formed from a ceramic or other material having comparably low thermal conductivity characteristics, the maximum thermal stresses generated remain localized closest to that surface. Recessing the bond joint material in a honeycomb structure or surface formed from bonded segments in accordance with the invention reduces the magnitude and the transmission of those greater stresses present at or near the honeycombed surface of each monolithic segment through the bond joints. Two examples of heat recovery wheels are formed according to the invention by cementing cellular segments to one another, the cement being applied to the sides of the cellular segments being joined so as to stop short, preferably approximately one-half inch (1.27 cm) short, of the outer surface of each segment which will form a portion of the annular face of each wheel exposed to the highest temperatures.

DETAILED DESCRIPTION OF THE INVENTION

Figure 1:
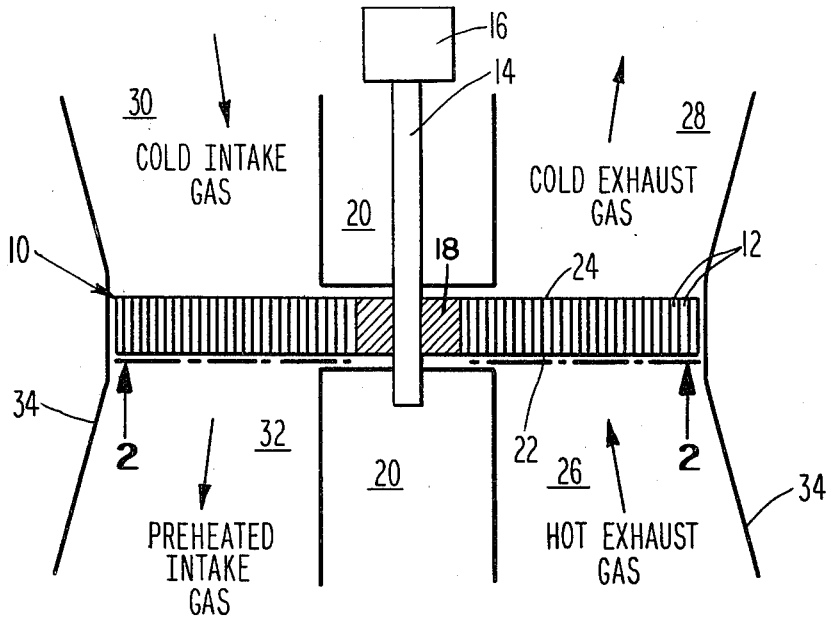
FIG. 1 is a diagrammatic view of a typical counterflow heat exchanger system using a heat recovery wheel.

FIG. 1 depicts a typical counterflow heat exchanger system using a rotary heat recovery wheel 10 made in accordance with the teachings of this invention. The wheel 10 has been cross-sectioned in FIG. 1 to expose an annular honeycomb matrix consisting of a plurality of substantially parallel open-ended, hollow cells 12 formed by thin webs of rigid material running axially from a first annular face 22 to a second annular face 24 through the thickness of the wheel 10.

Typically a shaft assembly 14 of steel or similar material is provided to support the wheel 10 through its central axis. In the system depicted, the shaft 14 is also used to rotate the wheel at a regular rate by a motor 16. The mechanical linkages between the shaft assembly 14 and motor 16 and between the shaft assembly 14 and the wheel 10 have been omitted from FIG. 1. Various types of shaft assemblies for mounting heat recovery wheels are disclosed in, among others, U.S. Pat. No. 3,978,914 to Phillips and applications Ser. Nos. 205,779 and 205,780 filed Nov. 10, 1980, the applications being assigned to the assignee of this application, and all being incorporated by reference herein. A cylindrically shaped hub 18 of solid material is typically provided integrally at the center of the wheel 10 to insulate the shaft assembly 14 from overheating and to support the mechanical stresses present in that area of the wheel. Alternatively, the central hub 18 may be a honeycombed matrix more densely celled than the remainder of the wheel or even dispensed with if the wheel is sufficiently small or the material used for form it sufficiently strong to withstand the maximum stresses, primarily mechanical, to which the central area of the wheel is exposed during operation. Also in the alternative, the wheel may be driven at its circumference.

The function of the wheel 10 is to transfer thermal energy between gases having differing temperatures flowing through opposite halves of the wheel 10. Seal columns 20 are positioned juxtaposed the annular faces 22 and 24, extending away therefrom and separating the hot and cold gases flowing through the wheel 10. Preferred seal columns for use in a counterflow heat exchanger system of the type being discussed, which extend beyond the central hub 18 of the wheel and shield it from direct contact with the hot and cold gas flows are described in a companion copending application Ser. No. 205,774 filed Nov. 10, 1980, assigned to the assignee of this application, and hereby incorporated by reference herein. Outer walls 34 surround the wheel 10 and seal columns 20 forming chambers 26, 28, 30 and 32 on either side of the wheel 10. The first chamber 26 funnels hot gas to a first annular face 22 of the wheel 10. In typical applications, the hot gas consists of combustion exhaust gases. The hot "exhaust" gas is forced by suitable means (not depicted) such as gravity, convection, a pump, or a fan, to flow through the cells 12 in the wheel 10 and in the process gives up its heat to the material forming the cells 12. The then cooled exhaust gas passes through the second annular face 24 of the wheel 10 into a second chamber 28 which in turn leads to a suitable means of disposal (not depicted). In time, the portion of the wheel 10 to the right of the shaft 14 (as viewed in FIG. 1), having been warmed by the hot exhaust gas, is rotated by the shaft 14 and motor 16 to the left side of the hub 18 and is exposed to a cold gas being channeled into a third chamber 30. Typically the cold gas is intake air to be preheated for combustion. The cold intake gas is forced by appropriate means (again not depicted) through the second annular face 24, cells 12 and first annular face 22 of the wheel 10 into a fourth chamber 32. In the process the cold intake gas absorbs the heat being held in material forming the cells 12 on the left side of the wheel 10 (as viewed in FIG. 1). The now warmed intake gas in the fourth chamber 32 is conducted away from the wheel 10 by suitable means (not depicted) for use. The hot exhaust and cold intake gases are run in opposite directions through the wheel 10 to maximize the thermal efficiency of the system. This results in "hot" and "cold" faces (the first annular face 22 and second annular face 24, respectively, in the system depicted in FIG. 1) in the wheel, the former operating at a higher average temperature than the latter.

Figure 2:
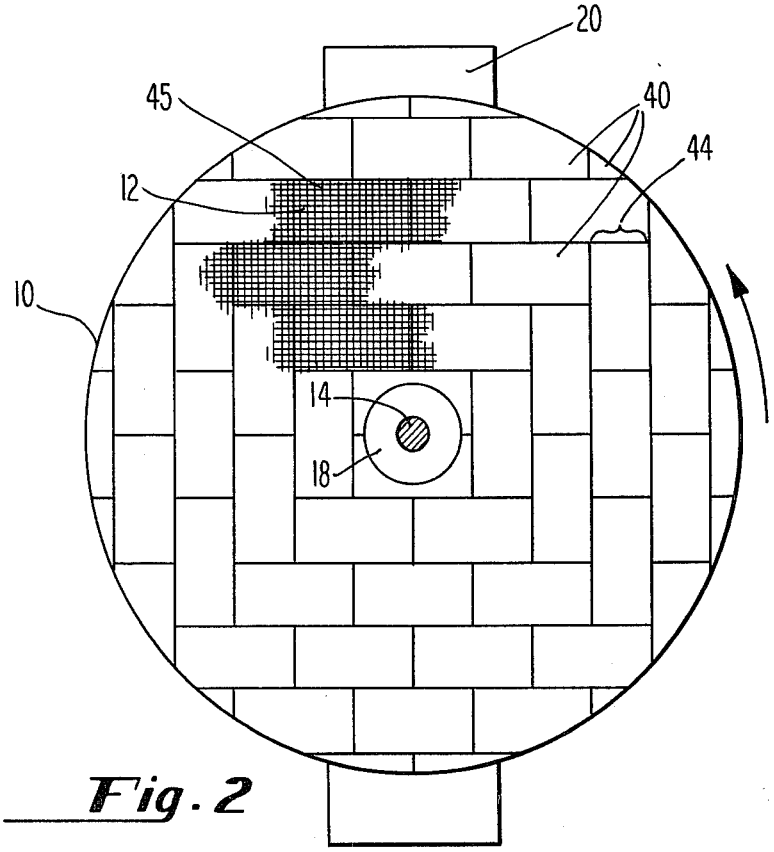
FIG. 2 is a diagrammatic view along line 2—2 of FIG. 1 depicting an annular face of a first example of a heat recovery wheel made by joining together extruded cellular segments in accordance with the teachings of the invention.

Referring now to FIG. 2, there is depicted the first annular "hot" face 22 of a first example of a heat recovery wheel 10 of FIG. 1 fabricated from extruded cellular segments in accordance with the teachings of this invention. The wheel 10 in FIG. 2 consists of a central cylindrically shaped hub 18 and a plurality of cellular segments in the form of relatively small blocks 40. As is partially depicted in magnification, each block 40 comprises a plurality of hollow, open-ended cells 12 formed from thin intersecting webs 45 (see also FIG. 3). The cells 12 extend between and their open ends form opposing honeycombed surfaces on two sides of each block 40. Peripheral side walls 46 (see FIG. 3) formed by the outermost layer of thin webs forming the outermost layer of cells 12 or by an essentially solid skin constitute the remaining outer surfaces of each block 40. The blocks 40 are positioned in a regular fashion and are joined to one another and to the outer cylindrical surface of the central hub 18 along their peripheral side walls. Each block 40 is arranged so that its honeycombed faces form a portion of the two open annular faces 22 and 24 of the resulting wheel 10. Typically cement is used to bond the blocks 40 together although other methods such as fusing or welding may be suitable for the materials being used.

The cells 12 in each block 40 can be extruded in a variety of geometries such as are disclosed in, among others, U.S. Pat. Nos. 4,127,691 to Frost and 4,135,018 to Bonin et al. A companion co-pending application Ser. No. 205,777 filed Nov. 10, 1980, also assigned to the assignee of this application, discloses preferred ceramic material, cement and arrangement of cell geometries and cellular segments to form a heat recovery wheel having square cells. The aforesaid patents and application are incorporated by reference herein. Typically, the aforesaid cells would be formed in a heat recovery wheel with walls approximately 0.010 to 0.012 inches (0.25 to 0.30 mm) thick and at cellular densities ranging from approximately 125 to more than 300 cells per square inch (19.4 to more than 46.5 cells per square cm), depending upon the pressure drop and thermal efficiency desired.

A joint 44 exists between each pair of adjoining blocks 40. Typically the materials used to form the hub 18 and blocks 40 and to bond them together have identical or very similar thermal expansion characteristics over the range of operating temperatures of the resulting wheel 10 to minimize the generation of stresses from uneven thermal expansion.

Figure 3:
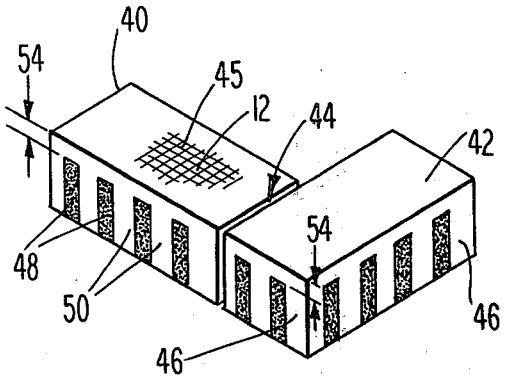
FIG. 3 is a perspective view depicting the manner in which cement is applied to the individual cellular segments comprising the wheel in FIG. 2.

FIG. 3 depicts two typical blocks 40 from the wheel 10 depicted in FIG. 2 joined in the preferred method. As can better be seen in this figure, each block 40 consists of a matrix of thin webs 45 (partially depicted in magnification) which extend through each block 40 to form the plurality of open-ended hollow cells 12 extending between opposing honeycombed surfaces 42 on the top and bottom of the blocks 40 (as viewed in FIG. 3). Also as viewed in FIG. 3, the top honeycomb surface 42 of each block 40 forms a portion of the resulting "hot" annular face of the wheel 10 (the first annular face 22 of the wheel 10 in FIG. 1). According to the invention the cement (indicated by the shaded stripes 48) is applied to the peripheral side walls 46 of each block by any means suitable for the cement selected so as to stop short of the resultant "hot" annular face of the wheel 10 (the top honeycomb surface 42 of each block 40 in FIG. 3) as is indicated by arrows 54. Also according to the invention, the distance between the arrows 54 is preferably approximately one-half inch (12.7 mm) when measured in its finished form (after firing and foaming, if applicable). The application of the cement in stripes 48 with discontinuities 50 therebetween, as is depicted in FIG. 3, is the subject of the aforesaid copending application Ser. No. 205,775, which is hereby incorporated by reference herein. Cement used to join the central hub 18 and blocks 40 is not recessed to provide increased strength and because the described seal columns shield the hub from direct impingement of the hot gas flow.

Figure 4:
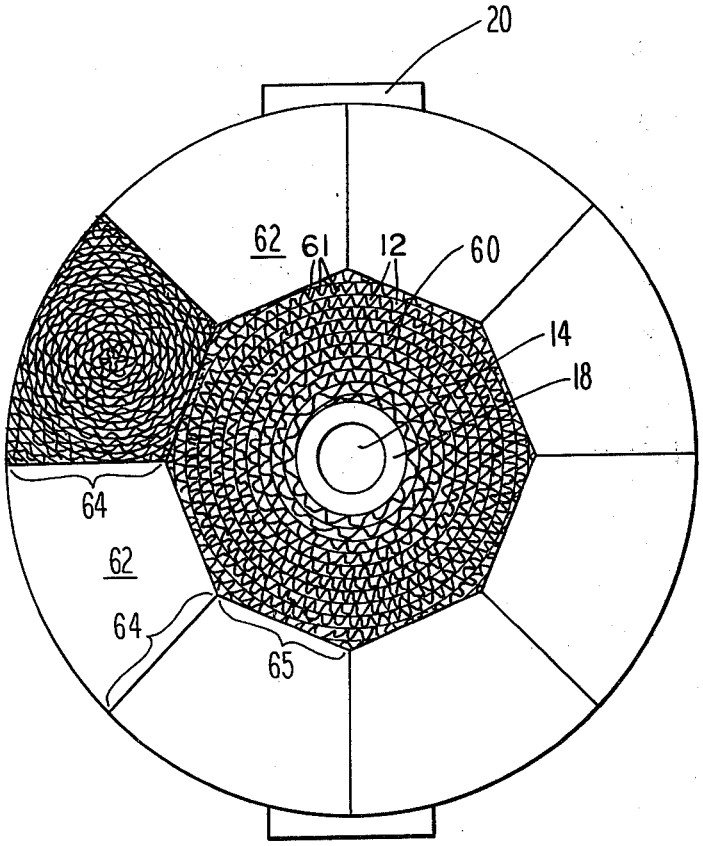
FIG. 4 is a diagrammatic view along line 2—2 of FIG. 1 depicting an annular face of a second ceramic heat recovery wheel made by joining together cellular segments formed by the wrap method.

Depicted in FIG. 4 is a heat recovery wheel 10 constructed by the wrap method from relatively large cellular segments which include an octagonal core 60 and eight surrounding "petals" 62. The petals 62 are symmetrically sized and shaped with respect to one another, evenly disposed around the periphery of the octagonal core 60 and extend to the outer circumference of the wheel 10. A joint 64 connects each pair of adjoining petals 62. Similarly, a joint 65 connects each petal 62 to the octagonal core 60.

The octagonal core 60 and petals 62 are formed by the wrap method of overlying layers of thin corrugated webs 61 of a sinterable, ceramic base material so as to create a matrix of hollow, open-ended cells 12 extending through each petal 62 and the octagonal core 60. The wrap method used in the fabrication of the octagonal core 60 and petals 62 is well known in the art and described in U.S. Pat. No. 3,112,184 to Hollenbach and other patents. The open ends of the cells formed by this method are depicted in great magnification in the octagonal core 60 and one petal. After forming, each wrapped segment is then cut and ground to shape. The octagonal core 60 is also bored to accept a cylindrically shaped, central hub 18 which is cemented into place. The hub 18 is solid and formed from a ceramic base material by a method suitable for the material selected. Preferably the hub is formed of the same material used to form the petals 62 and octagonal core 60 or from a material having a thermal coefficient of expansion closely approximating the material used to form those cellular segments so as to minimize stresses between the hub 18 and the octagonal core 60 caused by dissimilar thermal expansion. Heat recovery wheels as large as 70 inches (178 cm) in have been fabricated in this fashion with continuous cement joints extending up to and entirely across the two annular faces of the resulting wheel for some time by Corning Glass Works from a glass-ceramic material described in U.S. Pat. No. 3,600,204 having a coefficient of thermal expansion less than $10\times10^{-7}/°C.$ in the range 0° to 1000° Centigrade. Glass-ceramic cements having a comparably low thermal coefficient of expansion are used in the forming of these wheels. These include a glass-ceramic foaming cement produced in accordance with U.S. Pat. No. 3,634,111 and comprising by weight 4.0% zinc ZnO, 8.0% CaO, 3.4% SiC, and 84.6% glass frit of composition 1 set forth in Table I of that patent. A second glass-ceramic foaming cement described in Example No. 1 in Table II of that patent has also been used. Both U.S. Pat. Nos. 3,600,204 and 3,634,111 are incorporated by reference herein.

Figure 5:
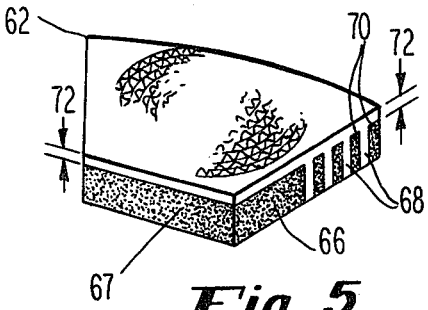
FIG. 5 is a perspective view of peripheral walls of a cellular segment depicted in FIG. 4 showing cement application in accordance with the teachings of the invention.

FIG. 5 depicts the application of cement to a single petal 62 in accordance with the invention. The open ends of the corrugated material are depicted in part on the top surface of the petals 62. That honeycombed surface also forms a portion of the hot annular face of the wheel 10 (the first annular face 22 of the wheel 10 in the system depicted in FIG. 1). A peripheral wall 66 faces a corresponding peripheral wall of an adjacent petal in the resulting wheel 10, and is connected thereto by a joint 64 (See FIG. 4). Peripheral wall 67 faces a peripheral wall of the octagonal hub 60 and is connected thereto by a joint 65 (Also in FIG. 4). The shaded areas on peripheral walls 66 and 67 indicate the location of cement. Discontinuities 68 are provided in the cement so as to allow passage of gas through a portion of the joint areas 64 between the adjoining petals, in accordance with the previously noted application Ser. No. 205,775. Cement segments 70 remain between the discontinuities 68. As in the case of the first embodiment, the cement used to join the central hub 18 and the octagonal core 60 is not recessed for the same reasons.

Sets of arrows 72 indicate the recessing of the cement in the joint areas 64 and 65 along the peripheral walls 66 and 67, respectively, from the resulting hot face 22 of the wheel 10 (see FIG. 1). Again according to the invention, the cement should be recessed, preferably approximately one-half inch (1.27 cm) when measured in its finished form (after firing and foaming if such steps are applicable to the cement used).

The approximately one-half inch (1.27 cm) recession of the bond joints disclosed as the preferred embodiment, was selected as apparently providing the greatest reduction of thermally induced stresses with the minimal removal of bond joint material. Analyzing the stresses in a 2.8 inch (7.1 cm) thick wheel at 0.28 inches (7.1 mm) increments axially through the wheel, applicants found that a 0.28 inch (7.1 mm) recession of the material would increase the safety factor of the wheel approximately 25% and a 0.56 inch (14.2 mm) recession approximately 50%. Improvement from further recession of the bond joint material was at a noticably lesser rate. It is believed that the actual safety factor improvements are less than those indicated by the analysis (due to the approximations made in the modeling leading to errors) but that the proportional rate of stress reduction indicated by the analysis is correct and generally applicable. Thus, although an approximately one-half inch (1.27 cm) recession is preferred, any recession will provide some improvement as compared to an unrecessed composite honeycombed surface such as are found on the heat recovery wheels described.

Although the invention has been described with respect to heat recovery wheels formed from single layers of cellular segments, it is envisioned that the invention can be practiced where the honeycombed structure is formed from layered cellular segments.

It is further envisioned that the invention can be practiced by recessing only a portion of the total number of bond joints or by recessing the joints to various degrees, or both, the recessing occurring or occurring to the greatest degree where the stress transfer problem is greatest.

Although it is easiest to practice the invention by originally forming the bond joints so as to stop short of the honeycomb surface subjected to thermal shock (such as the "hot" annular face of a heat recovery wheel) as described, applicants envision the invention to also be practiced by initially forming the joints so as to extend to the honeycomb surface subject to thermal shock and then removing a portion of the formed joints by etching, cutting, burning, grinding, or any other means suitable for the material used and structure involved so as to form joints which terminate short of that surface.

Although examples of the preferred embodiment of the invention have been shown and described in various alternatives and modifications have been suggested, it will be understood that the appended claims are intended to cover all embodiments and modifications which fall within the true spirit and scope of the invention.

We claim:

1. A method of improving the thermal shock resistance of honeycombed outer surface of a structure fabricated from ceramic, glass-ceramic, glass, sintered metal or cermet, said surface being formed from a plurality of cellular segments, said segments each being joined to one another along side walls by a bond joint of cement therebetween, said cement formed from ceramic, glass-ceramic, glass, sinterable metal, cermet or other ceramic base materials, comprising the steps of:

bonding each of said cellular segments to another of said cellular segments along one of said side walls of each so as to form a cement bond joint therebetween; and recessing a substantial plurality of said cement bond joints from said honeycombed surface whereby the thermal shock resistance of said surface is improved.

2. The method described in claim 1 wherein said steps of bonding said cellular segments and recessing said bond joints are combined in one step.

3. The method described in claim 2 wherein said bond joints are formed from cement and said combined step comprises applying the cement to said peripheral walls of said cellular segments so as to be formed short of said resulting honeycombed surface subject to thermal shock.

4. The structure produced by the step described in claim 1.

5. In a structure having a honeycombed surface comprising:

a plurality of segments fabricated from ceramic, glass-ceramic, glass, sintered metal or cermet or other ceramic base materials and positioned adjoining one another, each of said segments having a honeycombed face formed by a plurality of cells and forming a portion of said honeycombed surface and having outer side walls extending from said face; and a plurality of cement bond joints formed from ceramic, glass-ceramic, glass, sintered metal or cermet, each bond joint joining one of said outer sidewalls to another and being recessed from said honeycombed surface whereby the thermal shock resistance of said honeycombed surface is improved.

6. The structure described in claim 4 or 5 wherein said segments are formed from a material comprising a ceramic.

7. The structure described in claim 4 or 5 wherein said bond joints are recessed at least approximately one-quarter inch (6.4 mm) from said surface of said structure.

8. The structure described in claim 4 or 5 wherein said bond joints are recessed approximately one-half inch (12.7 mm) from said surface of said structure.

9. The structure described in claim 4 or 5 wherein said bond joints are recessed between one-quarter and one-half inch (6.4 and 12.7 mm) from said surface of said structure.

10. The structure described in claim 9 wherein said bond joints are all recessed a uniform distance from said surface of said structure.

11. A heat recovery wheel havng an annular face exposed to the highest temperature gases flowing through said wheel comprising:

a plurality of adjoining segments fabricated from ceramic, glass-ceramic, glass, sintered metal or cermet, each segment having a plurality of hollow, open-ended cells extending therethrough between a pair of honeycombed outer faces and a plurality of side walls forming its remaining outer surfaces; and a plurality of cement bond joints formed from ceramic, glass-ceramic, glass, sintered metal or cermet substantially each bond joint formed between said side walls of said adjoining segments and recessed from said annular face of said wheel whereby the thermal shock resistance of the wheel is improved.

12. The wheel described in claim 11 wherein said recessed bond joints are recessed at least approximately one-quarter inch (6.4 mm) from said annular face.

13. The wheel described in claim 11 wherein said recessed bond joints are recessed approximately one-half inch (12.7 mm) from said annular face.

14. The wheel described in claim 11 wherein said recessed bond joints are recessed between approximately one-quarter inch (6.4 mm) and one-half inch (12.7 mm) from said annular face.

15. The wheel described in claim 14 wherein said bond joints are all recessed a uniform distance from said annular face.

16. The method described in claim 1 comprising the additional step of:

creating a plurality of discontinuities in said bond joints in a direction approximately parallel to the central longitudinal axes of the cells of said cellular segments whereby fluids are allowed to flow through said honeycombed outer surface and the discontinuities of said bond joints.

17. The structure described in claim 5 wherein one or more of said bond joints has a plurality of discontinuities for fluids flow therethrough extending completely through it, in a direction approximately parallel to the central longitudinal axes of said cells adjoining said joints.

18. The heat recovery wheel described in claim 11 wherein one or more of said bonding joints has a plurality of discontinuities extending completely through it in an essentially axial direction for fluids flow therethrough.

* * * * *